United States Patent [19]

Bloemendal et al.

[11] Patent Number: 4,504,203

[45] Date of Patent: Mar. 12, 1985

[54] APPARATUS ADAPTED FOR USE AS A SCREW COMPRESSOR FOR MOTOR

[75] Inventors: Berend J. Bloemendal, Emmen; Marinus J. Grootte Bromhaar, Hengelo, both of Netherlands

[73] Assignee: Delta Screw Nederland B.V., Emmen, Netherlands

[21] Appl. No.: 458,773

[22] Filed: Jan. 18, 1983

[51] Int. Cl.[3] ..... F04C 2/24

[52] U.S. Cl. ..... 418/201

[58] Field of Search ..... 418/150, 191, 201, 202

[56] References Cited

U.S. PATENT DOCUMENTS 2,531,603 11/1950 Berck ..... 418/201

3,283,996 11/1966 Schibbye ..... 418/201

FOREIGN PATENT DOCUMENTS 2106186 4/1983 United Kingdom ..... 418/201

*Primary Examiner*—Leonard E. Smith

*Assistant Examiner*—Jane E. Obee

*Attorney, Agent, or Firm*—Bernard, Rothwell & Brown

[57] ABSTRACT

An apparatus adapted for use as a screw compressor or motor is provided, which comprises a housing (7) in which at least two cooperating rotors (1, 2) of unequal diameters are mounted. The sidewalls of the rotors have helical profiles. The rotor (2) of the smaller or smallest diameter has a substantially concave helical profile, which, as viewed in perpendicular cross-section, is formed as substantially equal, pit-shaped depressions. The helical profile of the other rotor (1) is substantially convex and rotation-symmetrical of a two- or more-sided shape with outwardly-curved flanks.

According to the invention, as viewed in perpendicular cross-section, the flanks of each of the pit-shaped depressions (14) of the rotor (2) having the smaller or smallest diameter are of epitrochoidal configuration, which two epitrochoidal flanks are optionally separated by a bottom portion having the form of an arc of a circle. Also, as viewed in perpendicular cross-section, each of the outwardly-curved flanks of the other rotor (1), for example flank 3–3′, from the two apexes (3,3′) of the flank to the center, are of epitrochoidal shape, which two outwardly-curved epitrochoidal flank portions are optionally separated by a central portion (12–13) having the form of an arc of a circle.

7 Claims, 6 Drawing Figures

APPARATUS ADAPTED FOR USE AS A SCREW COMPRESSOR FOR MOTOR

This invention relates to an apparatus adapted for use as a screw compressor or motor.

A well-known kind of screw compressor comprises a housing having a sidewall, two end walls, a gas inlet port and a gas outlet port; at least two cooperating rotors of unequal diameters, mounted for rotation in at least two, partially overlapping right cylinders, enveloping said rotors, said rotors having sidewalls with helical profiles, the rotor of the smaller or smallest diameter having a substantially concave helical profile which, as viewed in perpendicular cross-section, is formed as substantially equal, pit-shaped depressions; the helical profile of the other rotor being substantially convex and rotation-symmetrical of a two or more-sided shape with outwardly-curved flanks.

This known kind of screw-compressor is in practice only available in sizes having a capacity of more than 7.5 HP (5.5kW). The cause of this is that there is internal leakage via passages, generally referred to as blowholes, resulting from structurally faulty construction of the cooperating profiles of the rotors, owing to which compressed gas flows away from spaces of higher pressure to spaces of lower pressure. On a percent basis, such leakage losses form a greater disadvantage for compressors of smaller sizes, that is to say, with a lower output.

It is an object of the present invention to provide an apparatus of the above kind for use as a screw compressor or motor with a greatly reduced internal leakage, so that it may also be made in considerably smaller sizes with capacities of considerably less than 7.5 HP.

To this effect, according to the invention, there is provided an apparatus adapted for use as a screw compressor or motor, which is characterised in that, as viewed in perpendicular cross-section, the flanks of each of the pit-shaped depressions of the rotor having the smaller or smallest diameter, going from each of the two points of intersection with the circumference of the circular cross-section to the bottom of the depression are of epitrochoidal configuration, and the two epitrochoidal flanks are optionally separated by a bottom portion, having the form of an arc or a circle; and that, as viewed in perpendicular cross-section, each of the outwardly-curved flanks of the other rotor, going in the direction of the two apexes of the flank, which are located on the circumference of the circumscribed circle, to the center, is of epitrochoidal shape, and the two outwardly-curved epitrochoidal flanks are optionally separated by a central portion in the form of an arc of a circle.

The invention is based on the insight that an important aspect for reducing internal leakage losses is that the sealing edges of the rotors rolling one over the other must never be free, that is to say, these sealing edges must always make contact with either the cylindrical wall of the corresponding channels in which these rotors rotate, or the profile of those of the co-operating rotor.

It is true that the insight described in the preceding paragraph is known per se. Thus Dutch patent application No. 81.04434 indicates, for achieving the same purpose in an apparatus suitable for use as a screw compressor, that the profiles of the co-operating rotors should be of such configuration that, during operation, their lines of contact always intersect one of the lines of intersection of the cylinders enveloping the rotors. In the practical elaboration, and the configurational requirements of the profiles indicated therefor, however, it turns out that the object is not achieved. In fact, while on the one hand each of the rotors is only generally indicated to have helical profiles separated from each other by an intermediate piece having at least one non-rounded edge, which intermediate piece may, for that matter, apparently be of any shape, the specification indicates with regard to the configuration of the helical profile with which the non-rounded or sharp edge is intended to co-operate, that the co-operating flank portion thereof is of trochoidal shape, i.e. not of epitrochoidal shape.

Furthermore, an apparatus suitable for use as a screw compressor is known from U.S. Pat. No. 2.243,847. The profile shape of the flanks of the rotor having the larger diameter of this prior apparatus is described as being formed, as viewed in perpendicular cross-section from three consecutive unequal curves, to adjacent curves of which are a circular arc of circles having unequal diameters. The shape of the channel of the profile of the rotor having the smaller diameter which cooperates with the rotor having the larger diameter, is then such that the wall of the channel, as viewed in perpendicular cross-section, is composed of two adjoining unequal curves, one of which is a circular arc. Furthermore, adjacent channels of this rotor of the prior apparatus turn out to be separated from each other by a dividing wall, tooth-shaped in perpendicular cross-section, and the flanks of which are greatly undercut and hence technically complicated to make.

Finally, French patent No. 967,547 describes an apparatus suitable for use as a screw compressor in which the cooperating rotors also have profiles satisfying specific shapes. As viewed in perpendicular cross-section, the profile of the channel-shaped depression of the rotor having the smaller diameter is of epitrochoidal configuration, like that according to the present invention. Unlike the invention, however, the shape of the flank portion of the helical profile of the rotor having the larger diameter, is epicycloidal.

As will be elucidated hereinafter, the flank portions of the cooperating profiles of both the rotor having the smaller diameter and the rotor having the larger diameter should both be of epitrochoidal configuration to satisfy the condition that the sealing edges of the rotors rolling over one another must never become free, i.e. these sealing edges must always make contact with either the wall of the cylindrical channels enveloping the rotors, or the profile flanks of the other cooperating rotor. If this condition is not satisfied, apart from inevitable manufacturing tolerances, there will be permanent or temporary open connections between the spaces of higher pressure and those of lower pressure as the rotors are rolling over each other, and consequently leakage losses will occur.

A combination of the aspects of an efficient manufacture, a high capacity, and a small size is optimal for the apparatus according to the invention if the rotor having the smaller diameter has six channel-shaped depressions, and the cooperating rotor having the larger diameter has a triangular shape with outwardly-curved flanks, and in particular if, in the rotor having the smaller diameter, the width of each channel-shaped depression gradually increases from the bottom towards the upper edges, so that there are not undercuts.

It has been found that, used as a screw-compressor, the apparatus according to the invention, owing to the specific conditions satisfied by the two rotors, has such a small leakage passage, that it functions well even in sizes having a considerably lower capacity than 7.5 HP (5.5kW), for example, even a capacity of no more than 1 HP.

Moreover, the requirements to be satisfied by the two rotors lead to a symmetrical cross-sectional configuration of the rotors, so that they can be made on conventional machines, for example, a normal milling machine or a profile grinder.

By selecting the rotor diameter, the width and depth of the channel can be varied. It is preferable for the channel to be wide and shallow, as in that case there is no need to fear the occurrence of undercuts.

In a preferred embodiment of the invention, the rotor bearings at the high-pressure end of the apparatus are mounted within the rotors. This results in a shortened distance between the bearings supporting the rotor, as a consequence of which vibrations are greatly reduced, and deflection of the rotors is prevented. In a further elaboration of this preferred embodiment, the bearings at the high-pressure end are mounted within the respective rotors by mounting the bearings of each of the two rotors around a stub shaft, which shafts are passed through corresponding openings in, and secured to, an end wall formed integrally with the housing at the high-pressure end. These structural measures have the further advantage that free surface area is saved on the fixed end wall, which offers the possibility of a further preferred embodiment, according to the invention, in which the gas outlet port is provided within the saved free surface area of the end wall, and accordingly the apparatus according to the invention is provided with an axial gas outlet port.

Such an axial disposition of the gas outlet port has the advantage that the gas in the compression space can be expelled to leave a smaller residual quantity of gas than is possible with a radial arrangement of the gas outlet port, which is the conventional arrangement. The desired end pressure of the gas can be pre-set during the manufacture of the apparatus: displacing the outlet in the direction of rotation of the rotors will result in a later efflux moment, and hence a higher end pressure: during their rotation, the two rotors keep the gas outlet port closed with their end faces for such a period of time that the desired degree of compression has been reached, whereafter the outlet port is released and the compressed gas can be discharged. Accordingly, in this way the outlet port functions as a non-return valve during a portion of the revolution of the rotors, which partly owing to the small stroke volume, results in a low starting torque.

Indeed, starting is possible without any special provision for unloaded start, such as shutting off the suction stub.

In practice, the gas outlet port will preferably be situated inthe end wall immediately past the point of intersection of the overlapping cylinders, as viewed in the direction of the imaginary line interconnecting the centers of rotation of the rotors.

The invention will be described in greater detail with reference to the accompanying drawings, in which FIG. 1 shows a perspective elevational view of the two rotors to be used in the apparatus according to the invention;

Figure 2:
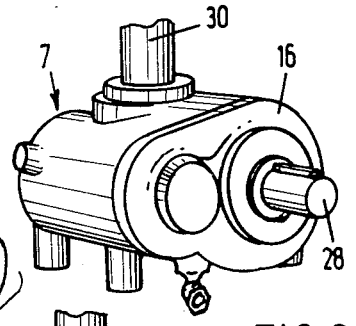
FIG. 2 shows the apparatus according to the invention as a screw compressor in perspective elevational view from the low-pressure end.
Figure 3:
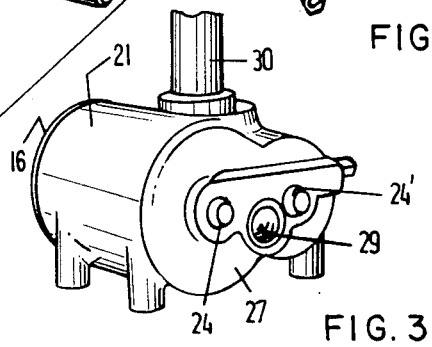
FIG. 3 shows the screw compressor of FIG. 2 in perspective elevational view from the high-pressure end.
Figure 4:
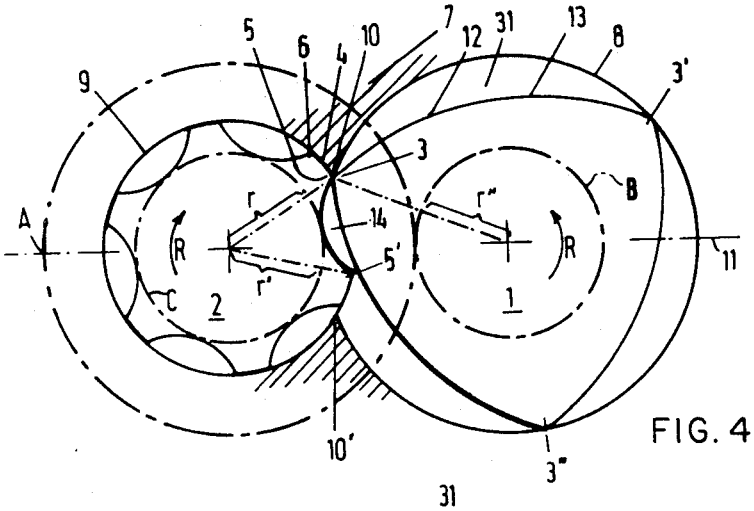
Figure 5:
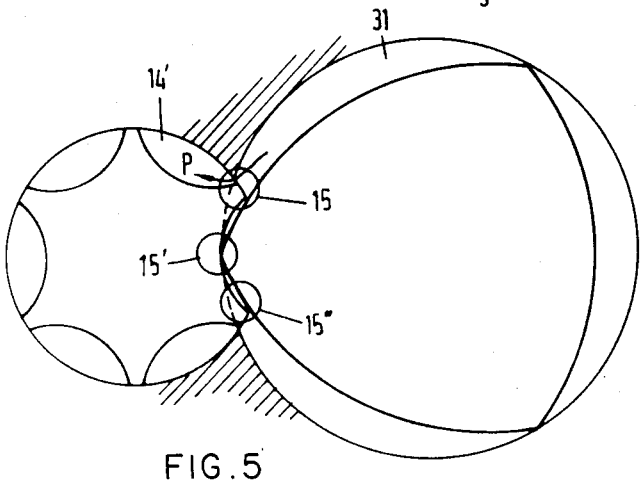
Figure 6:
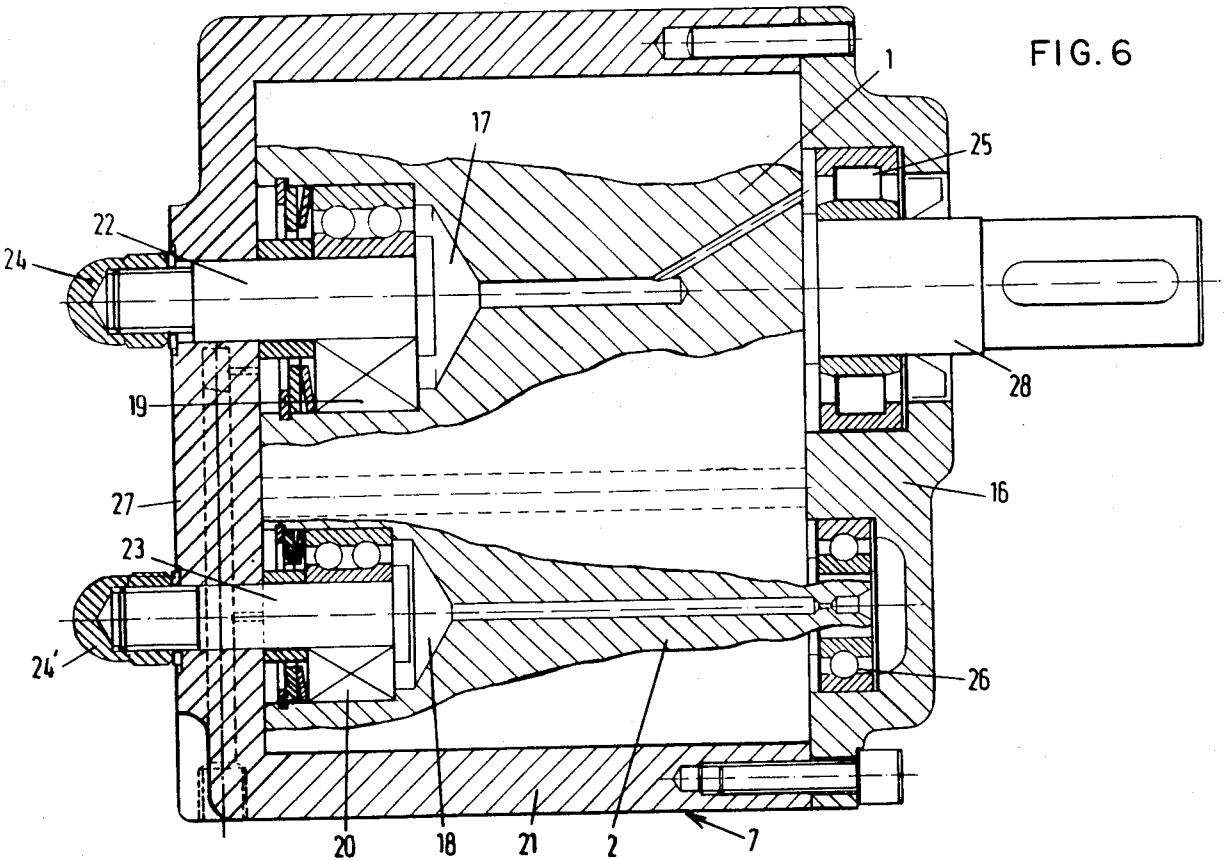

FIG. 4 diagrammatically shows a cross-sectional view of a screw compressor according to the invention;

FIG. 5 diagrammatically shows a cross-sectional view of the screw compressor of FIG. 4 with the rotors rotated slightly further; and FIG. 6 shows a horizontal longitudinal sectional view of the screw compressor of FIG. 2 and FIG. 3.

Figure 1:
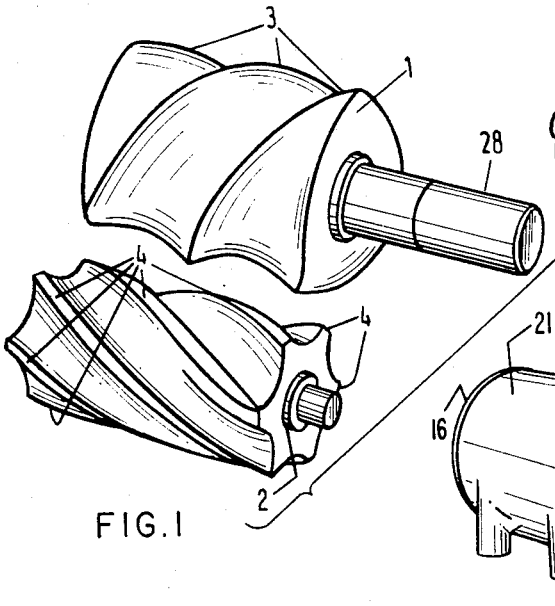

Referring to the drawings, FIG. 1 shows in perspective view a rotor of larger diameter, or male rotor 1, arranged to cooperate with a rotor of smaller diameter, or female rotor 2. In the embodiment shown, the male rotor has three helices, and the female rotor six. The helices of the male rotor are separated from each other by a single sharp, i.e. non-rounded edge 3, and the helices of the female rotor are separated from each other by lands 4, which via sharp edges 5,6 (FIG. 4) merge into the adjacent helices. The outer surface of land 4 is formed in accordance with the circumscribed cylinder of the female rotor 2. The object of land 4 is to improve sealing between the helices. It will be clear that the male rotor 1 may also be formed with such a land.

FIG. 4, 7 designates a housing having two intersecting cylindrical bores 8 and 9, so that sharp edges 10 and 10' are formed in the housing at the lines of intersection. Rotors 1 and 2 are journaled in the bores, with the outer surfaces of the rotors being in sealing contact with the interior surface of the bore concerned.

Noting that the rotor shapes are defined in the cross-section perpendicular to the axis of rotation, i.e. the perpendicular cross-section, the following is observed with reference to FIGS. 4 and 5.

In the position of the two rotors 1 and 2 shown in FIG. 4, edge 3 of the male rotor 1 is in point 10 of housing 7. When the two rotors 1, 2 rotate in the direction of arrows R, the edge 3 of rotor 1 will come into contact with the female rotor 2, while the edge 5 of rotor 2 will come into contact with the male rotor 1.

The edge 3 of rotor 1 meets the edge 5 of rotor 2 in point 10. Accordingly, without breaking the contact, edge 3 moves from the housing to rotor 2, and until now has satisfied the condition that the sealing edges should at all times make contact with either the wall of cylinder 8, or the profile of the cooperating rotor. In order to continue to satisfy these conditions during further rotation, the edge 3 of rotor 1 will have to cooperate with flank 5—5' of depression 14, and edge 5 has to cooperate with the flank 3—3' of rotor 1 or edge 5' with flank 3—3'. In order to further define the shape of flank 5—5' of depression (14 and of the other corresponding depressions of rotor 2) and of flank 3—3' (and the other corresponding flanks of rotor 1), auxiliary circles A, B and C have been drawn in FIG. 4. The radius of circle A is equal to that of the circumscribed circle 8 of rotor 1; circle C is the inscribed circle of rotor 2, and the radius thereof is equal to that of the auxiliary circle B and accordingly $r=r'=r''$.

It can be derived from FIG. 4 that, if during the rolling of rotors 1 and 2 over each other, edge 3 should continuously make contact with the flank 5—5' of depression I4, the shape of flank 5—5' is to be defined as corresponding to the curve traced by the edge 3 as a point on the extension of radius r'' of auxiliary circle B when circle B rolls along the stationary auxiliary circle A. Thus the shape of flank 5—5' is defined as corresponding with an epitrochoid.

If, during the rolling of rotors 1 and 2 over each other, edge 5 should maintain contact with flank 3—3' of rotor 1, the shape of flank 3—3' is to be defined as corresponding to the curve traced by the edge 5 as a point on the extension of radius r when auxiliary circle C rolls along the circumscribed circle 8 as the stationary circle, so that the shape of flank 3—3' has been fixed as corresponding to an epitrochoid. With edge 5' as a point on the extension of radius r' of auxiliary circle C, therefore, the shape of flank 3—3' will also be defined as an epitrochoid, etc. The greatest depth of depression 14 is of course equal to the difference of the radii of circles 8 and 9 circumscribing the rotors 1 and 2.

As the helices of rotor 2 as shown in FIG. 4 are separated from each other by a land 4, the outer surface of which is formed in accordance with the circumscribed cylinder 9 of rotor 2, it is in this case impossible for the full flank 3—3' to be of epitrochoidal shape. In fact, at the moment when edge 5 passes the line interconnecting the centres of rotation of the rotors, edge 5 loses contact with flank 3—3', which contact is taken over by the cylindrical surface of land 4. Edge 5 leaves the flank 3—3' at point 12. From point 12, the cylindrical surface of land 4 rolls along the flank until, at point 13, edge 6 comes into contact with the flank. This is the moment when edge 6 passes line 11. The flank portion 12—13, therefore, has the form of an arc of a circle, while the next flank portion 13—3', which cooperates with edge 6, has again the shape of an epitrochoid. Flank 3—3' of rotor 1 is therefore composed of two epitrochoidal parts 3—12 and 13—3', separated by the circular arc 12—13.

Owing to this specific configuration of the rotors, these roll along each other without forming any blowholes. Space 14, which contains the compressed gas under high pressure, is continuously sealed by 3 sealing lines as indicated by means of the encircled; areas 15,15' and 15'' (FIG. 5).

During the further rotation of rotors 1 and 2 from the position shown in FIG. 4 into the direction of arrows R, land 4 penetrates space 31, owing to which the air present in this space is compressed and heated. At the moment when edge 6 rotates past the point of intersection of the circumscribed circles 8 and 9, pressure equalisation will take place, whereby, as shown in FIG. 5, the compressed air flows from space 31 to space 14' (arrow P), which means that a portion of the air in the combined spaces 14'—31 is re-compressed, which comes down to a loss in capacity for the compressor. It is preferable, therefore, that the blowhole loss caused as a result of the width of land 4, should be kept as low as possible by minimizing this width, and choosing it not larger than is strictly necessary for a proper sealing relative to the enveloping cylinder of rotor 2.

It will be clear that if the male rotor 1 is also provided with a land, the configuration of depression 5—5' should be adapted accordingly, that is to say, that an intermediate portion having the shape of an arc of a circle must be provided.

The depth and width of the depressions can be varied by selecting the rotor diameters. A wide shallow depression in the female rotor, as shown in FIG. 4, however, is desirable for reasons of manufacturing technology, as these can be milled with normal tools without there being any need to fear undercuts Housing 7 (FIG. 6) is an assembly of a detachable cover 16, with which the housing is closed at one end, and the housing section comprising sidewall 21 and end wall 27, which are formed in one piece. The male rotor 1 and female rotor 2 are mounted at the end of cover 16 in the usual way, using bearings 25 and 26 respectively. The male rotor is provided at the same end with a fixed shaft 28. Via this shaft the male rotor is driven when the apparatus is used as a compressor, for it to carry along the female rotor. When the apparatus is used as a motor, power is imparted to the shaft.

At the other end the male rotor 1 and the female rotor 2 are provided with central bores 17 and 18, respectively. Housed in the central bores, for supporting the rotors at these ends, are bearings I9 and 20, respectively, mounted around stub shafts 22 and 23, respectively, which are passed to the outside through openings in the fixed end wall 27, where they are secured to end wall 27 by means of blind nuts 24 and 24', respectively.

Provided in the fixed end wall is a gas outlet port 29 (Fig.3) while, in the vicinity of cover I6, the housing is provided at the top with a gas inlet port to which a suction stub 30 is connected for radially supplying gas to be compressed to the compressor. The gas outlet port 29 is screw threaded, as shown in FIG. 3, so as to provide a means for connecting a compressed gas supply line to this port for use of the apparatus as a screw motor.

Naturally, the apparatus as shown hereinbefore and shown in the accompanying drawing, can be modified and changed without departing from the scope of the invention.

We claim:

1. Apparatus adapted for use as a screw compressor or motor, comprising a housing having a side wall, two end walls, a gas inlet port and a gas outlet port; at least two cooperating rotors of unequal diameters mounted for rotation in at least two, partially overlapping, right cylinders enveloping said rotors, said rotors having sidewalls with helical profiles, the rotor of the smaller or smallest diameter having a substantially concave helical profile, which, as viewed in perpenicular cross-section, is formed as substantially equal, pit-shaped depressions; the helical profile of the other rotor being substantially convex and rotation-symmetrical of a two- or more-sided shape with outwardly-curved flanks, characterized in that, as viewed in perpendicular cross-section, each of the pit-shaped depressions of the rotor having the smaller or smallest diameter has flanks going from each of the two points of intersection with the circumference of a circle circumscribing said rotor having the smaller or smallest diameter to the bottom of the depression, said flanks being of epitrochoidal configuration, and that, as viewed in perpendicular cross-section, each of the outwardly-curved flanks of the other rotor, going in the direction of the two apexes of the flanks, which apexes are located on the circumference of a circle circumscribing said other rotor to the centre, is of epitrochoidal shape.

2. The apparatus as claimed in claim 1 wherein said two epitrochoidal flanks of said rotor having the smaller or smallest diameter are separated by a bottom portion having the form of an arc of a circle and said two outwardly curved, epitrochoidal flanks of said other rotor are separated by a central portion in the form of an arc of a circle.

3. Apparatus as claimed in claim 1, in which the rotors are journaled in the end walls of the housing, characterized in that, at the high-pressure end of the apparatus, the bearings of each of the rotors are mounted within the rotor in a co-axial bore formed in the end face of the rotor.

4. Apparatus according to claim 3, in which at least one of the end walls of the housing is a detachable cover, characterized in that each of the bearings mounted within the rotors at the high-pressure end is mounted around a stub shaft, said shaft being passed through corresponding openings in, and being secured to, an end wall formed in one piece with the housing at the high-pressure end.

5. Apparatus according to claim 4, in which the housing has a radial gas inlet port and a gas outlet port, characterized by the provision of one or more openings in said fixed end wall, said openings functioning as gas outlet ports and being closable by the end faces of the rotors during a portion of the revolution of the latter.

6. Apparatus according to claim 5, characterized in that the openings functioning as gas outlet ports are provided virtually immediately after the point of intersection of the line of intersection of the overlapping cylinders with the fixed end wall.

7. Apparatus according to claim 6, characterized in that the gas outlet port is provided with means for connecting the gas outlet port to a compressed-gas supply line for the use of the apparatus as a screw motor.

* * * * *